US007435152B2

(12) United States Patent
Kimbrough

(10) Patent No.: US 7,435,152 B2
(45) Date of Patent: Oct. 14, 2008

(54) APPARATUS AND METHOD FOR CENTRIFUGAL MATERIAL DEPOSITION AND PRODUCTS THEREOF

(75) Inventor: Richard W. Kimbrough, Santa Fe, NM (US)

(73) Assignee: R & J Inventions LLC, Mendham, NJ (US)

( * ) Notice: Subject to any disclaimer, the term of this patent is extended or adjusted under 35 U.S.C. 154(b) by 784 days.

(21) Appl. No.: 10/942,408

(22) Filed: Sep. 16, 2004

(65) Prior Publication Data

US 2005/0082388 A1 Apr. 21, 2005

Related U.S. Application Data

(63) Continuation-in-part of application No. 10/245,960, filed on Sep. 18, 2002, now Pat. No. 6,793,151.

(51) Int. Cl.

| | |
|---|---|
| ***A63H 23/00*** | (2006.01) |
| ***A63H 1/00*** | (2006.01) |
| ***B05C 11/02*** | (2006.01) |
| ***B05C 13/00*** | (2006.01) |
| ***B05C 13/02*** | (2006.01) |
| ***B43K 5/02*** | (2006.01) |
| ***B05B 3/02*** | (2006.01) |
| ***F23D 11/04*** | (2006.01) |

(52) U.S. Cl. ..... 446/156; 446/233; 446/236; 446/256; 118/52; 401/143; 239/222

(58) Field of Classification Search ..... 239/215, 239/222, 225.1, 226, 237, 243, 248, 263.1, 239/263.2, 379, 382, 523, 524; 446/48, 233, 446/236, 256, 259, 264, 266, 267; 222/144, 222/167, 168, 169; 401/143, 151; 118/52, 118/55

See application file for complete search history.

(56) References Cited

U.S. PATENT DOCUMENTS

| | | | | |
|---|---|---|---|---|
| 1,289,779 | A | | 12/1918 | Howard |
| 1,289,892 | A | | 12/1918 | Perry |
| 2,199,309 | A | | 4/1940 | Freudenberg |
| 2,294,588 | A | | 9/1942 | Von Pazsiczky |
| 2,433,000 | A | | 12/1947 | Manning |
| 2,497,369 | A | | 2/1950 | Peyches |
| 2,587,710 | A | | 3/1952 | Downey |
| 2,624,912 | A | | 1/1953 | Heymes et al. |
| 2,721,418 | A | * | 10/1955 | Peabody, Sr. ..... 446/211 |
| 3,017,663 | A | | 1/1962 | Levecque et al. |
| 3,097,085 | A | | 7/1963 | Wallsten |

(Continued)

*Primary Examiner*—Len Tran
*Assistant Examiner*—Ryan Reis
(74) *Attorney, Agent, or Firm*—O'Connell Law Firm

(57) ABSTRACT

A centrifugal dispensing apparatus with a centrifugal dispensing drum that can be divided into compartments and that has at least one open inner volume for retaining a volume of flowable material, an exit aperture for each open inner volume for allowing flowable material to pass during a rotation of the centrifugal dispensing drum, and a drive shaft. A catch shield or a cam operated plunger arrangement for sealing off the exit aperture in a directionally sensitive manner can be provided. Flowable material can be deposited in lines onto flat surfaces, curved surfaces, and non-flat surfaces that can be rendered flat after the application of flowable material thereto. The centrifugal dispensing drum, which can be modular, can take the form of a top or can be retained by a gimbaled gyroscopic arrangement.

22 Claims, 13 Drawing Sheets

U.S. PATENT DOCUMENTS

| | | | | |
|---|---|---|---|---|
| 3,749,315 | A | | 7/1973 | Crathern ..... 239/224 |
| 3,825,337 | A | | 7/1974 | Lucas ..... 399/41 |
| 4,032,607 | A | | 6/1977 | Schulz |
| 4,094,702 | A | | 6/1978 | Rabuffetti ..... 134/10 |
| 4,178,336 | A | | 12/1979 | Snowden |
| 4,294,408 | A | | 10/1981 | Snyder et al. |
| 4,294,783 | A | | 10/1981 | Snowden |
| 4,384,661 | A | | 5/1983 | Page et al. ..... 222/394 |
| 4,392,614 | A | | 7/1983 | Groth et al. |
| 4,553,700 | A | | 11/1985 | Snyder et al. |
| 4,919,333 | A | | 4/1990 | Weinstein |
| 4,948,409 | A | | 8/1990 | Chenoweth et al. |
| 4,954,059 | A | | 9/1990 | Lee et al. |
| 5,026,057 | A | * | 6/1991 | Watford ..... 273/108.1 |
| 5,277,641 | A | * | 1/1994 | Gable et al. ..... 446/46 |
| 5,314,098 | A | | 5/1994 | Milenkevich ..... 222/463 |
| 5,393,256 | A | * | 2/1995 | Mitchell et al. ..... 446/15 |
| 5,460,498 | A | | 10/1995 | Steel et al. |
| 5,693,280 | A | | 12/1997 | Pellegrin |
| 5,817,206 | A | | 10/1998 | McAlea et al. ..... 156/272.8 |
| 6,029,905 | A | | 2/2000 | van der Steur |
| 6,042,885 | A | | 3/2000 | Woollard et al. |
| 6,089,946 | A | * | 7/2000 | Yang ..... 446/259 |
| 6,170,298 | B1 | * | 1/2001 | Skarzenski et al. ..... 65/521 |
| 6,365,412 | B1 | | 4/2002 | Feygin ..... 436/45 |
| 6,508,983 | B1 | | 1/2003 | McBurney et al. ..... 422/44 |

* cited by examiner

APPARATUS AND METHOD FOR CENTRIFUGAL MATERIAL DEPOSITION AND PRODUCTS THEREOF

This application is a continuation-in-part of application Ser. No. 10/245,960, filed Sep. 18, 2002 now U.S. Pat. No. 6,793,151.

FIELD OF THE INVENTION

The present invention relates generally to material disposition through centrifugal action. Stated more particularly, this patent discloses and protects a centrifugal apparatus and method for depositing materials and to the products of that apparatus and method.

BACKGROUND OF THE INVENTION

One knowledgeable in the art will be aware that prior art centrifugal material disposition devices typically comprised paint spraying devices wherein centrifugal action was employed to induce atomization of paint. To do so, paint would be fed onto a rapidly rotating disk. Paint droplets would thereby be distributed centrifugally from a spinning edge of the disk and onto the article to be painted. With this, swaths of the article to be painted would be covered with a mist of centrifugally dispensed droplets.

In some cases, the direction of the distributed paint could be controlled with a peripheral wall and what can be considered a gate that is disposed external to the spinning disk. Any paint not passing through the gate would be caught by the peripheral wall and drained back into the source container. Advances relative to these types of centrifugal material dispensing systems are typically measured in terms of improvements in paint metering, more accurate control of flow rates, and more even distribution of paint droplets.

While the deposit of droplets of material onto articles of manufacture has been extensively developed, there remains a need for a dispensing apparatus and method that can deposit material in lines onto selected articles of manufacture to achieve plural advantages in design and function. Therefore, it will be apparent that there is a need for such a centrifugal dispensing apparatus and method that fills the gaps left by the prior art. It is clearer still that a centrifugal dispensing apparatus and method that meets all relevant needs left by the prior art while providing a number of heretofore unrealized advantages thereover would represent a marked advance.

SUMMARY OF THE INVENTION

Advantageously, the present invention sets forth with the broadly stated object of providing a centrifugal apparatus and method for depositing flowable materials onto articles that solve each of the problems left by the prior art while providing a number of heretofore unrealized advantages thereover.

Stated more particularly, one object of the present invention is to provide a centrifugal dispensing apparatus and method that enables the application of ornamental designs to articles of material in a quick, convenient, and unique manner.

A further object of the invention is to provide a centrifugal dispensing apparatus and method that can apply straight lines even to articles of material that are not flat.

Yet another object of the invention is to provide a centrifugal dispensing apparatus and method that can make a flat article of material appear curved or otherwise non-flat.

Still another object of the invention is to provide a centrifugal dispensing apparatus and method that can enable control over a direction of material dispensing from the centrifugal dispensing apparatus.

These and further objects and advantages of the present invention will become obvious both to one who reviews the present specification and drawings and to one who has an opportunity to make use of an embodiment of the present invention.

In accomplishing the aforementioned objects, a most basic embodiment of the present invention for a centrifugal dispensing apparatus for depositing volumes of flowable material onto a surface comprises a centrifugal dispensing drum with an open inner volume defined by an outer shell for retaining a volume of flowable material, an exit aperture in the outer shell of the centrifugal dispensing drum for allowing flowable material to pass therethrough by centrifugal force, and a drive shaft coupled to the centrifugal dispensing drum for enabling a rotation of the centrifugal dispensing drum. Under this arrangement, the centrifugal dispensing drum can dispense flowable material onto a surface by a rotation of the centrifugal dispensing drum while a volume of flowable material is retained therein.

Of course, flowable materials of a wide variety of types could be disposed in the open inner volume of the centrifugal dispensing drum. In preferred embodiments, the volume of flowable material will comprise a material demonstrating a long rheology wherein the flowable material exhibits stringy and web-like properties. Where such a material is employed, the volume of flowable material can advantageously form an elongate string of material emanating from the exit aperture for being applied to a surface. One material that is particularly preferable for use as the flowable material is a 100% polymer emulsion, which can be colorless or colored. A most preferred polymer emulsion comprises a clear tar gel polymer emulsion.

The centrifugal dispensing drum certainly can have a single, unitary open inner volume. In other embodiments, however, the open inner volume can be divided into first, second, and further separate open inner volumes with an exit aperture associated with each. With this, distinct volumes of flowable material can be retained in each of the first and second open inner volumes and dispensed from the first and second open inner volumes by centrifugal force during a rotation of the centrifugal dispensing drum.

A driving arrangement for rotating the centrifugal dispensing drum can take the form of a power drill with a handle portion, an activating trigger, and a drill chuck for drivably engaging the drive shaft and the centrifugal dispensing drum. Alternatively, the driving arrangement can take the form of an integral driving arrangement that comprises a single unit with the centrifugal dispensing drum.

In certain embodiments, the centrifugal dispensing drum can further incorporate a means for sealing off the exit aperture in a directionally sensitive manner. With such a means provided, flowable material can be prevented from being emitted in unintended directions and the flowable material can be directed onto a surface. The means could, of course, take a number of forms. In one preferred case, the means comprises a cam operated plunger arrangement for sealing off the exit aperture during at least one given segment of a rotation of the centrifugal dispensing drum and for leaving the exit aperture unsealed during at least one remaining segment of the rotation of the centrifugal dispensing drum. The cam can have a surface with at least one narrowed portion and at least one widened portion, and the plunger can have a first end with a follower for traveling over at least part of the surface of the cam and a second end with a plug for sealing off the exit aperture of the centrifugal dispensing drum when the follower of the plunger travels over a widened portion of the cam. The cam can be fixed relative to the driving arrangement while the plunger can rotate with the centrifugal dispensing drum.

Where necessary or desirable, the centrifugal dispensing apparatus can further incorporate a feeding tube for supplying flowable material to the open inner volume of the centrifugal dispensing drum. This supply can be achieved by providing an annular open ring in the centrifugal dispensing drum and having a distal end of the feeding tube disposed through that annular open ring and into the open inner volume of the centrifugal dispensing drum. With this, flowable material can be introduced into the open inner volume even during rotation of the centrifugal dispensing drum.

The centrifugal dispensing apparatus can be used in a variety of methods for applying flowable material to an article to achieve unique advantages in design and convenience. For example, one process under the present invention could begin with the provision of a centrifugal dispensing apparatus with a centrifugal dispensing drum and a driving arrangement for rotating the centrifugal dispensing drum.

A volume of flowable material can be disposed in the open inner volume of the centrifugal dispensing drum, and the driving arrangement can be activated to induce the centrifugal dispensing drum into rotation at an angular speed sufficient to cause a volume of flowable material to exit the open inner volume of the centrifugal dispensing drum through the exit aperture. With the flowable material exiting the open inner volume, at least part of the exiting volume of flowable material can be applied to the article.

The preferred flowable material can again comprise a material demonstrating a long rheology, such as a 100% polymer emulsion, wherein the flowable material will exhibit stringy and web-like properties such that it will form an elongate string of material emanating from the exit aperture for being applied to the article. With such a flowable material provided, the article onto which the material is applied can be curved or otherwise non-flat and the centrifugal dispensing apparatus can nonetheless deposit straight lines thereon. The article could certainly be permanently non-flat, such as would be the case with a sculpture, a vase, or any other type of structure.

Alternatively, the article could comprise an article of sheet material, such as paper, canvas, or fabric, with at least one non-flat portion temporarily formed therein. In such a case, the article of sheet material can be flattened out after at least some lines of flowable material have been applied thereto whereby the previously straight lines will become curved thereby giving the article of sheet material a non-flat appearance even while it is flat.

With a plurality of embodiments of the present invention for a centrifugal dispensing apparatus and method described, one will appreciate that the foregoing discussion broadly outlines the more important features of the invention merely to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a centrifugal apparatus and method for depositing materials and the products of that apparatus and method are subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
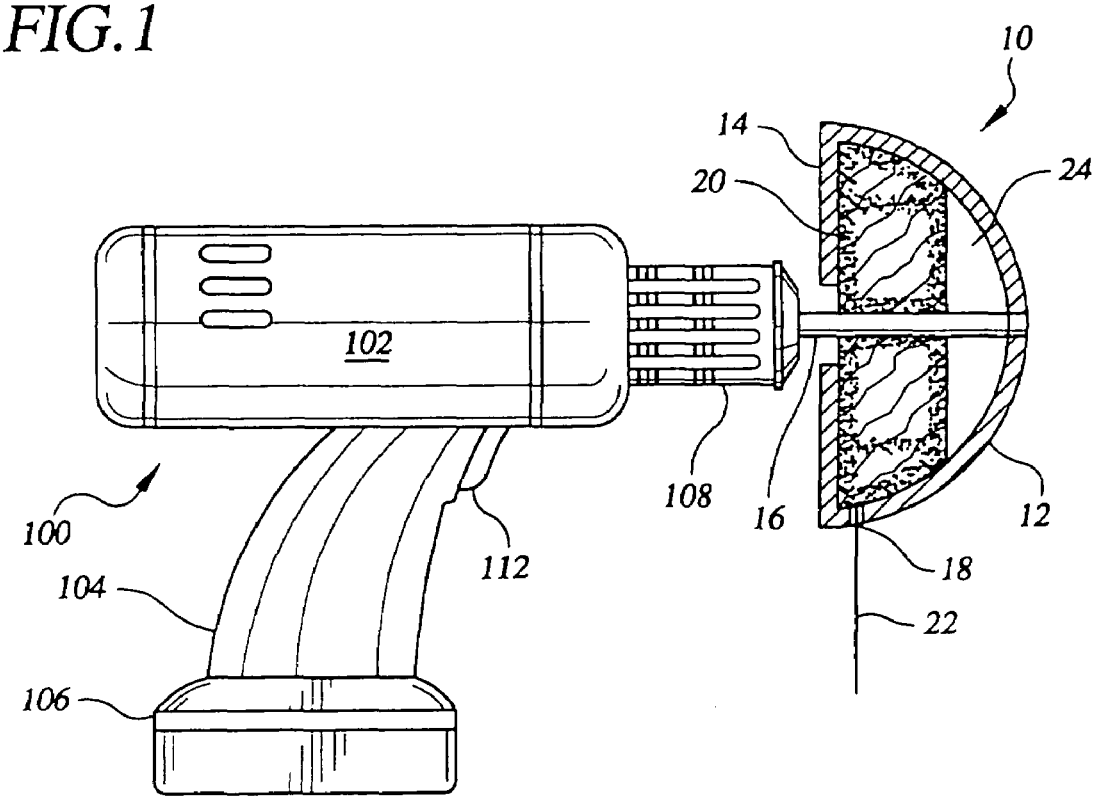
FIG. 1 is a sectioned view in side elevation of a centrifugal dispensing drum according to the present invention shown operably associated with a power drill.

With this in mind and looking more particularly to the accompanying figures, a first preferred embodiment of a centrifugal dispensing drum is indicated generally at 10 in FIG. 1. There, the centrifugal dispensing drum 10 is shown operably coupled to a rotary driver or driving arrangement 100, which in this case comprises a power drill. The power drill 100 has a motor housing 102 that retains an electric motor. A handle 104 extends from the motor housing 102, and a rechargeable battery pack 106 is removably and replaceably coupled to a distal end of the handle 104. A squeeze trigger 112 is provided adjacent to a proximal portion of the handle 104 for inducing the electric motor into operation to achieve a rotation of a drill chuck 108. Advantageously, the rotary speed of the drill chuck 108 is dependent on the extent to which the trigger 112 is squeezed.

The centrifugal dispensing drum 10 of this embodiment has an annular open inner volume 24 defined by an outer shell 12, which in this case is hemispherical, and a rear wall 14, which in this case is flat. A drive shaft 16 has a distal end fixed to the outer shell 12, a body portion extending through the inner volume 24 and through the rear wall 14, and a proximal portion for being drivably secured by the drill chuck 108. An exit aperture 18 is disposed in the periphery of the outer shell 12.

In FIG. 1, the centrifugal dispensing drum 10 is depicted as it would appear while being rotated by the power drill 100 with a volume of flowable material 20 disposed in its inner volume 24. Under this arrangement, centrifugal force will overcome, at least in part, the force of gravity to cause the flowable material 20 to ring and press against the outer periphery of the annular inner volume 24. With this, the flowable material 20 will tend to be forced by centrifugal force through the exit aperture 18. Depending on a number of factors, including the type of flowable material 20 employed, the flowable material 20 exiting through the exit aperture 18 can take the form of a line of material 22.

Of course, the flowable material 20 could be of a wide variety of types. For example, it could be substantially any type of liquid including liquid paint, glue, and substantially any other type of liquid. Alternatively, the flowable material 20 could be in the form of particulate matter or the like. Indeed, the flowable material 20 could comprise a combination of different material types, such as a combination of particulate matter suspended in a liquid, which again could be paint, glue, and substantially any other liquid.

The inventor has discovered that unique and advantageous results can be realized by employing a flowable material 20 that demonstrates a long rheology. By long rheology, it is meant that the preferred flowable material 20 will exhibit stringy and web-like properties such that, when used in normal circumstances, it can be dripped over a given surface to achieve desired results. This could be achieved by the selection of a flowable material 20 that exhibits what can be considered a syrupy, pully, tar-like feel and consistency.

A most preferred flowable material 20 that meets the aforedescribed requirements is a properly crafted polymer emulsion, which ideally is a 100% polymer emulsion. Artists have commonly made use of such polymer emulsions by dripping them over surfaces to be decorated. For example, fine lines can be laid on a surface by simply dipping a tool, such as a palette knife, into the polymer emulsion and then moving it quickly over the surface. Advantageously, the line thickness can be controlled by the size of the dispensing area of the tool and the speed with which it is moved. With a proper material selection of the long rheology product, very long strands of material can be created. This is not possible with other paints and like materials. In other cases where, for example, edible goods are to be colored, the flowable material 20 could be founded on honey, melted chocolate or fudge, gelatin, or a sugar and water mix.

Under a certain most preferred practice of the invention, the flowable material 20 can comprise a clear tar gel polymer emulsion, such as that sold by GOLDEN ARTIST COLORS®, Inc. of New Berlin, N.Y. as GOLDEN® Clear Tar Gel. Since the GOLDEN® Clear Tar Gel exhibits tar-like properties while being water based, it can be used under the present invention in producing unique artistic designs on paper, canvas, ceramic, and substantially any other material. In doing so, the Clear Tar Gel can form an elongate string of material 22 emanating from the exit hole 18 whereby the string of material 22 can be quickly and easily applied to substantially any desired product. The flowable material 20 can be of substantially any color, or it can be entirely colorless. Where necessary or desirable, the Clear Tar Gel can be mixed or thinned with other materials.

In any case and particularly where a polymer emulsion is used, the flowable material 20 can be mixed with a volume of soap solution, which has been found to prevent clogging of the flowable material. The soap solution can be formed essentially as one would form soap bubble solution wherein liquid soap, such as dishwashing soap, is diluted with water. A volume of glycerin can additionally be mixed with the dishwashing soap and water. Although the relative proportions can vary, one version of the soap solution can be created by mixing roughly ½ cup of dishwashing liquid with about 4 and ½ cups of water and approximately 4 tablespoons of glycerin.

Where necessary or desirable, a colorant can be added to the flowable material 20 or flowable material 20 can be procured that is pre-colored. Of course, one skilled in the art would be readily aware of sundry methods for adding color to the flowable material 20. For example, a volume of acrylic paint could be mixed into the flowable material 20. Food coloring could alternatively be used as a colorant in certain applications, such as where the invention is to be used by or around small children or where the flowable material 20 is to be applied to edible goods.

Figure 2:
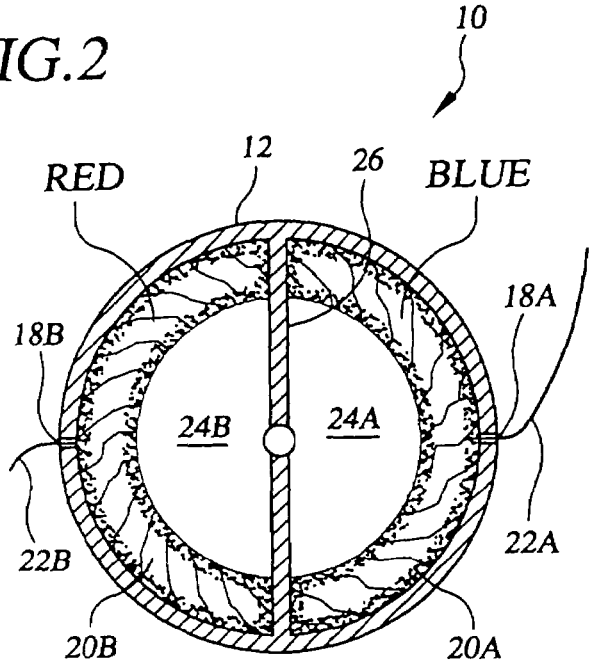
FIG. 2 is a sectioned view in front elevation of an alternative embodiment of the centrifugal dispensing drum according to the present invention.

Although the centrifugal dispensing drum 10 of FIG. 1 is shown as retaining only one volume of flowable material 20, it should be appreciated that a centrifugal dispensing drum 10 can be crafted under the present invention with multiple compartments for maintaining multiple different colors or types of flowable material 20. For example, FIG. 2 shows in front elevation an alternative embodiment of the centrifugal dispensing drum 10 wherein the centrifugal dispensing drum 10 is divided into a first open inner volume 24A for retaining a first volume of flowable material 20A, such as a volume of blue Clear Tar Gel, and a second inner volume 24B for retaining a second volume of flowable material 20B, such as a volume of red Clear Tar Gel, by a radial dividing wall 26. The first open inner volume 24A has an exit aperture 18A for enabling a first string of material 22A to emanate therefrom while the second open inner volume has an exit aperture 18B for enabling a second string of material 22B to emanate therefrom.

Figure 2A:
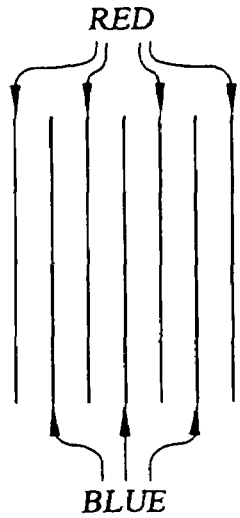
FIG. 2A is a depiction of a series of lines that might be deposited by the centrifugal dispensing drum of FIG. 2.

Such a centrifugal dispensing drum 10 can be used to lay down the lines shown in FIG. 2A. There, one sees that the lines alternate between red and blue, which is the result of the first and second strings of material 22A and 22B that have been centrifugally emitted from the first and second open inner volumes 24A and 24B. Advantageously and as will be discussed more fully below, the spacing and orientation of the lines can be controlled by a movement of the spinning centrifugal dispensing drum 10 relative to the surface on which the lines are to be deposited.

Figure 3:
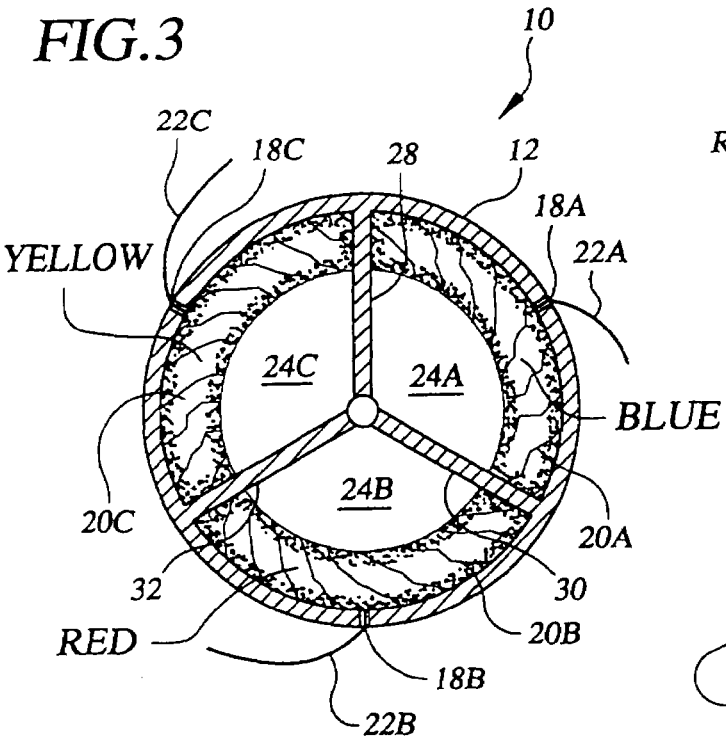
FIG. 3 is a sectioned view in front elevation of another alternative embodiment of the centrifugal dispensing drum.

Another embodiment of the centrifugal dispensing drum 10 is shown in FIG. 3. There, the centrifugal dispensing drum 10 is divided into first, second, and third open inner volumes 24A, 24B, and 24C for respectively retaining first, second, and third volumes of flowable material 20A, 20B, and 20C. In each case, the preferred volume of flowable material 20A, 20B or 20C would be a volume of Clear Tar Gel of a different color or composition than the other volumes of flowable material 20A, 20B, or 20C. For example, the first, second, and third volumes of flowable material 20A, 20B, and 20C could be volumes of blue, red, and yellow Clear Tar Gel respectively. The first, second, and third open inner volumes 24A, 24B, and 24C in this embodiment are separated by first, second, and third radial dividing walls 28, 30, and 32. The first, second, and third open inner volumes 24A, 24B, and 24C have first, second, and third exit apertures 18A, 18B, and 18C respectively for respectively forming first, second, and third strings of material 22A, 22B, and 22C.

Figure 3A:
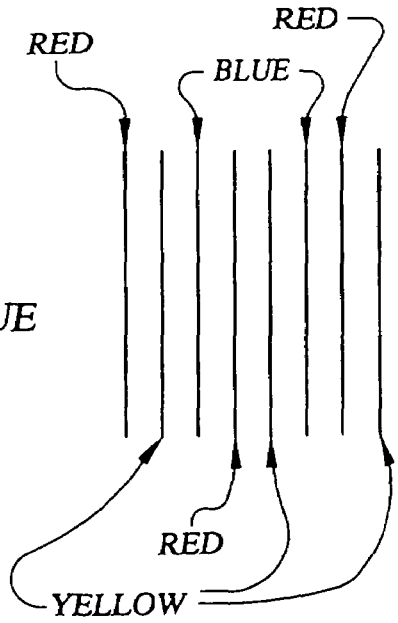
FIG. 3A is a depiction of a series of lines that might be deposited by the centrifugal dispensing drum of FIG. 3.

Such a centrifugal dispensing drum 10 can be used to lay down the lines shown in FIG. 3A. In FIG. 3A, it is shown that the centrifugal dispensing drum 10 of FIG. 3 can be used to lay down lines in repeated series of blue, red, and yellow. Again, the spacing and orientation of the lines can be controlled by a movement of the spinning centrifugal dispensing drum 10 relative to the surface on which the lines are to be deposited. Of course, the colors of the individual lines are merely exemplary and are of little consequence.

Figure 16:
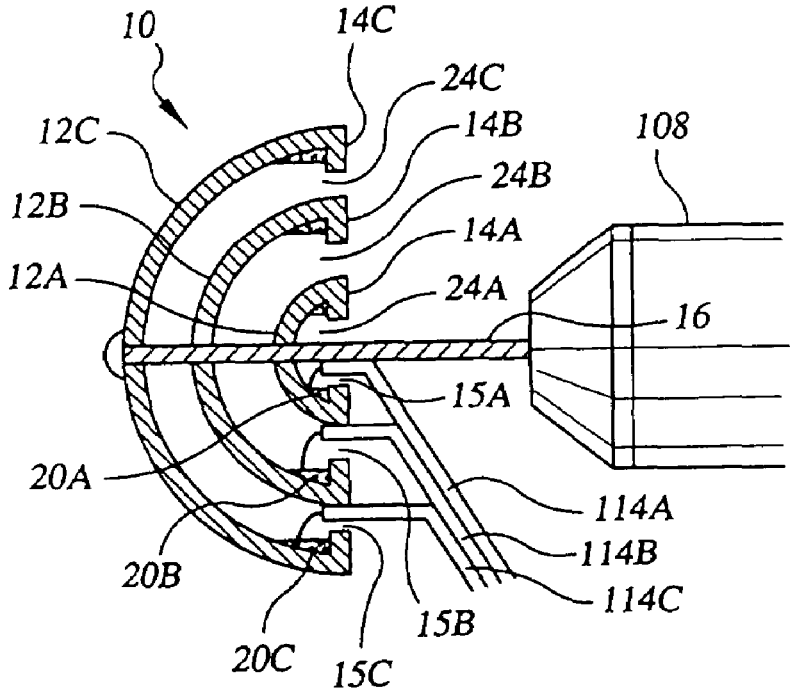
FIG. 16 is a sectioned view in side elevation of a further embodiment of the centrifugal dispensing drum.
Figure 17:
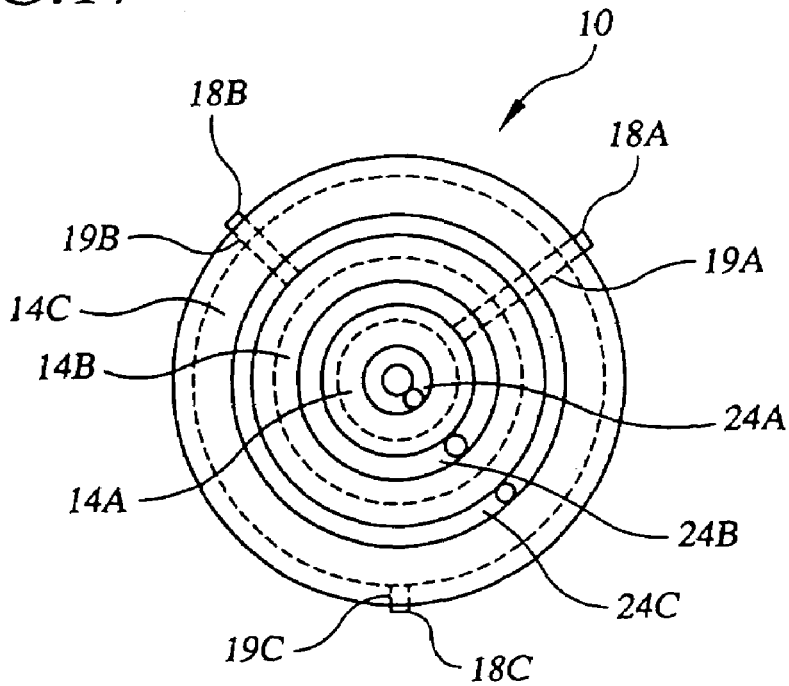
FIG. 17 is a view in front elevation of the centrifugal dispensing drum of FIG. 16.

In alternative embodiments, the centrifugal dispensing drum 10 could be divided into multiple inner volumes by concentric outer shells as is shown in FIGS. 16 and 17. There, first, second, and third concentric, hemispherical outer shells 12A, 12B, and 12C of progressively increasing size are retained by the drive shaft 16. The first, second, and third outer shells 12A, 12B, and 12C define first, second, and third inner volumes 24A, 24B, and 24C. First, second, and third rear walls 14A, 14B, and 14C cap off the first, second, and third inner volumes 24A, 24B, and 24C except for annular open rings 15A, 15B, and 15C that allow first, second, and third feeding tubes 114A, 114B, and 114C to supply flowable material 20A, 20B, and 20C to the first, second, and third inner volumes 24A, 24B, and 24C.

The first outer shell 12A has a first radial exit tube 19A that leads to a first exit aperture 18A for allowing the emission of a string (not shown) of flowable material 20A. Similarly, the second and third outer shells 12B and 12C have second and third exit tubes 19B and 19C leading to second and third exit apertures 18B and 18C respectively. With this, separate strings (not shown) of flowable material 20A, 20B, and 20C can be separately emitted from the centrifugal dispensing drum 10.

Figure 4:
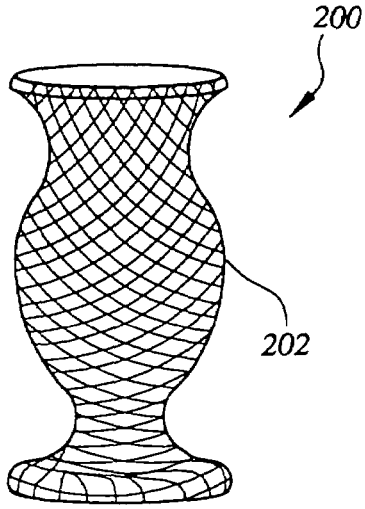
FIG. 4 is a perspective view of a vase with a plurality of lines deposited thereon according to the present invention.
Figure 5:
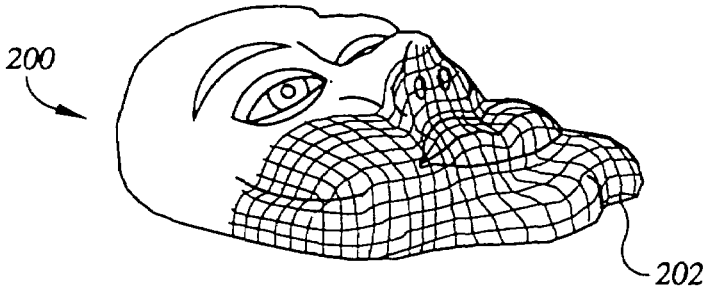
FIG. 5 is a perspective view of a sculpture with a plurality of lines deposited thereon also according to the present invention.

Whether the centrifugal dispensing drum 10 has one, two, three or more open inner volumes 24, it can be used to apply lines of material, such as the Clear Tar Gel, to substantially any product, whether it be made from paper, canvas, ceramic, or any other material. Advantageously, the centrifugal dispensing drum 10 can apply straight lines of material to products having curved surfaces. For example, FIG. 4 shows a product 200 in the form of a vase that has curved surfaces with a plurality of straight lines 202 of the flowable material applied thereto. Similarly, FIG. 5 shows a product 200 in the form of a sculpture with a plurality of curved surfaces and a plurality of straight lines 202 of flowable material applied thereto. As one will appreciate and as FIGS. 4 and 5 also show, the straight lines 202 can be applied first with a first orientation and then with second and further orientations simply by moving the rotating centrifugal dispensing drum 10 over the products 200 in corresponding orientations.

Figure 6:
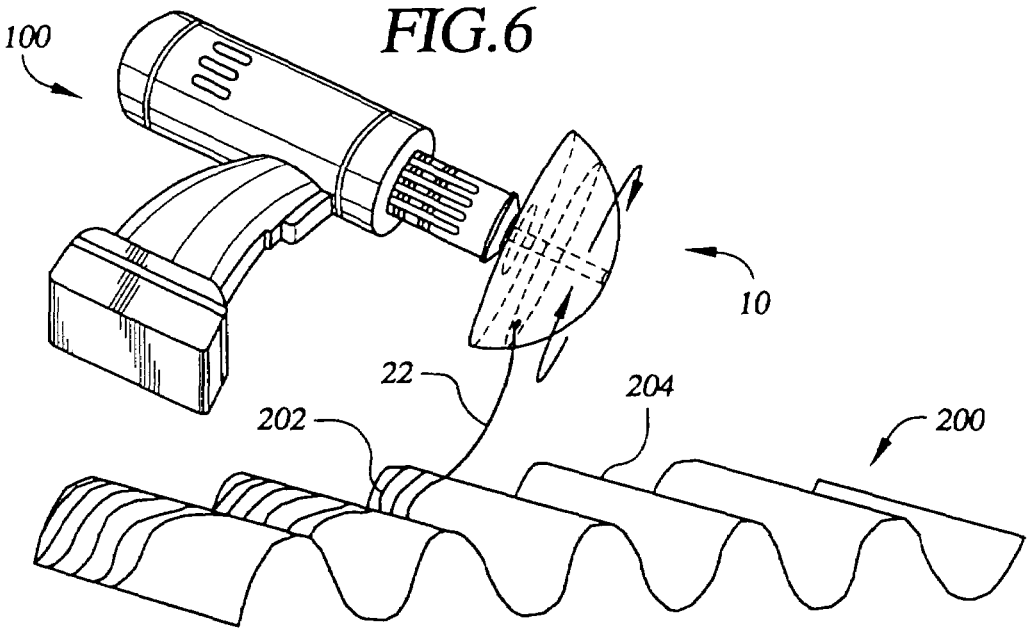
FIG. 6 is a perspective view of material being dispensed onto a product according to the present invention.
Figure 12:
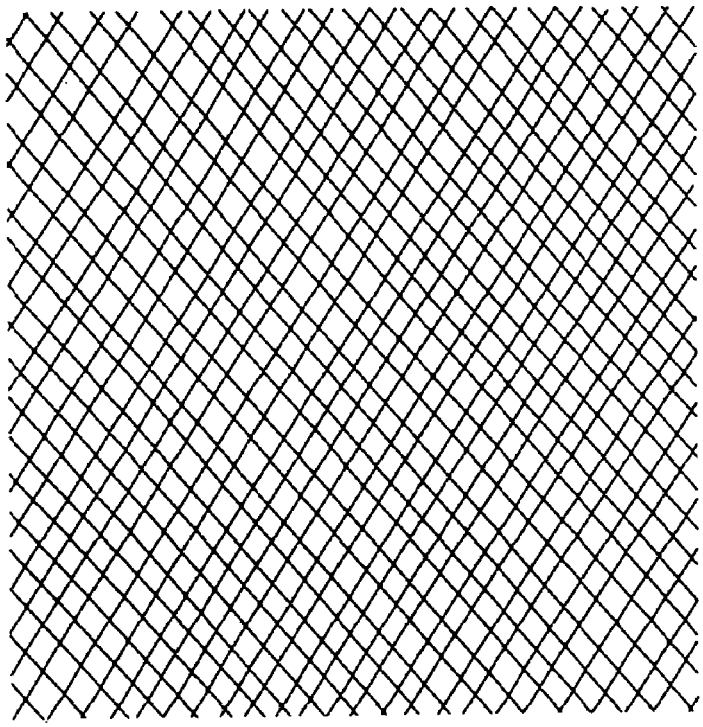
FIG. 12 is a top plan view of a product in process according to the present invention.
Figure 15:
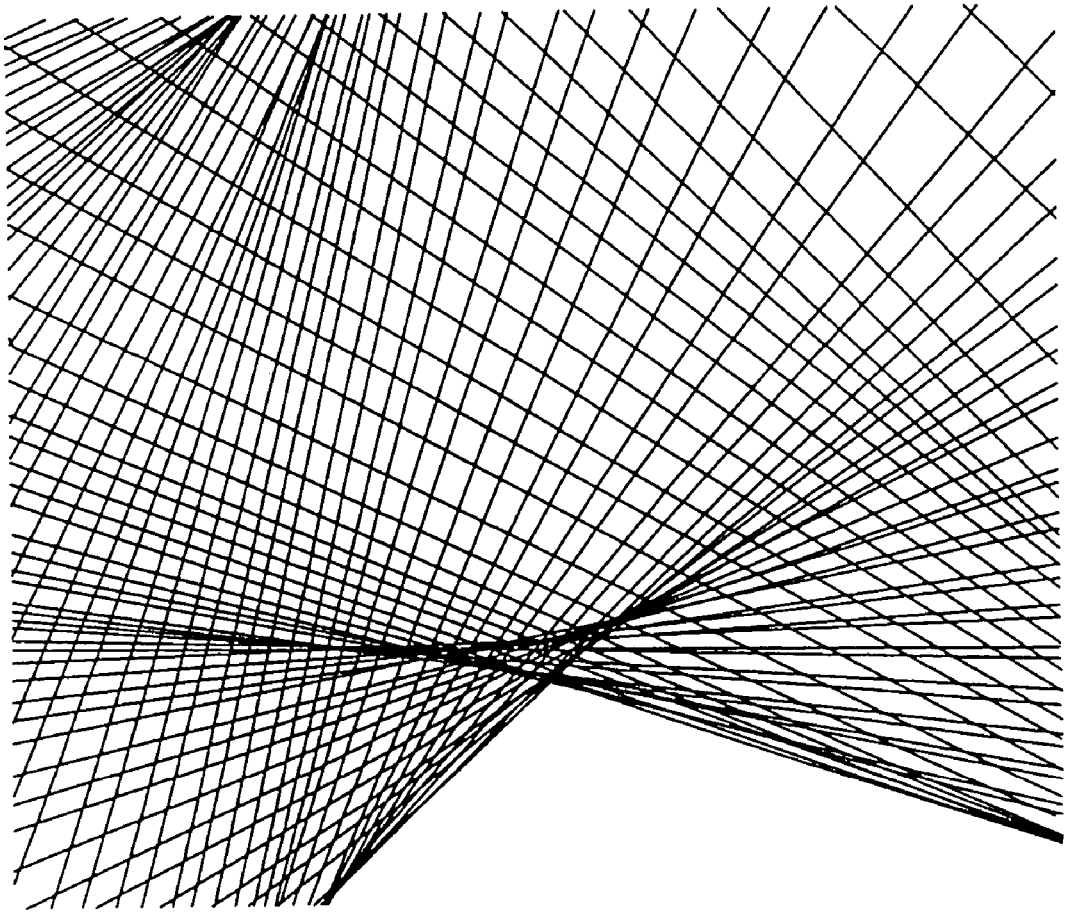
FIG. 15 is a top plan view of a product of the present process for centrifugal material disposition.

FIG. 6 shows a step in a process according to the invention of applying lines of material to a product 200. There, the product 200 comprises a length of sheet material, which is also indicated at 200. The sheet material 200 could comprise paper, canvas, fabric, or any other type of sheet material. In an initial step of the process, as FIG. 6 shows, a plurality of waves, wrinkles, curves, or other non-flat portions are created in the sheet material 200. Then, the centrifugal dispensing drum 10 is passed over the sheet material 200 while being rotated by a power drill 100 as one or more strings of material 22 is emitted therefrom. With this, lines of material 202 are laid on the surface of the sheet material 200. If desired, the orientation of the centrifugal dispensing drum 10 and thus of the lines of material 202 can be varied during a single application or in successive applications to produce varied designs such as the designs shown in FIGS. 12 and 15.

Figure 7:
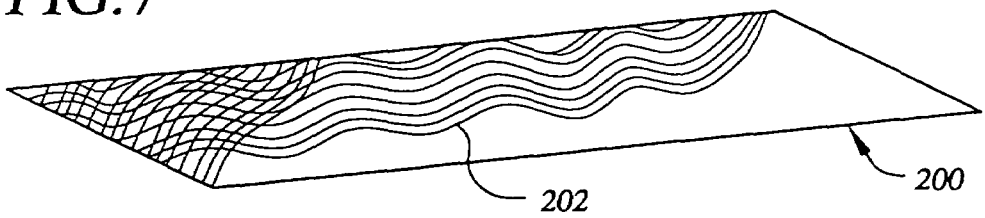
FIG. 7 is a perspective view of the product of FIG. 6 with material disposed thereon.
Figure 13:
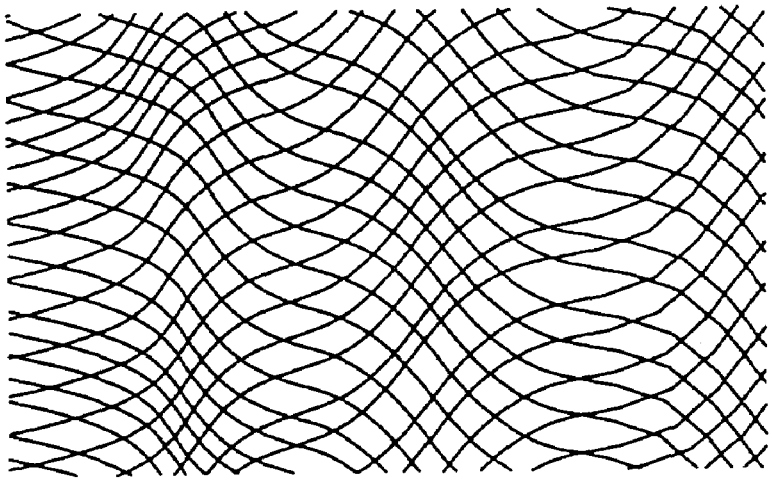
FIG. 13 is a top plan view of the finished product of FIG. 12.
Figure 14:
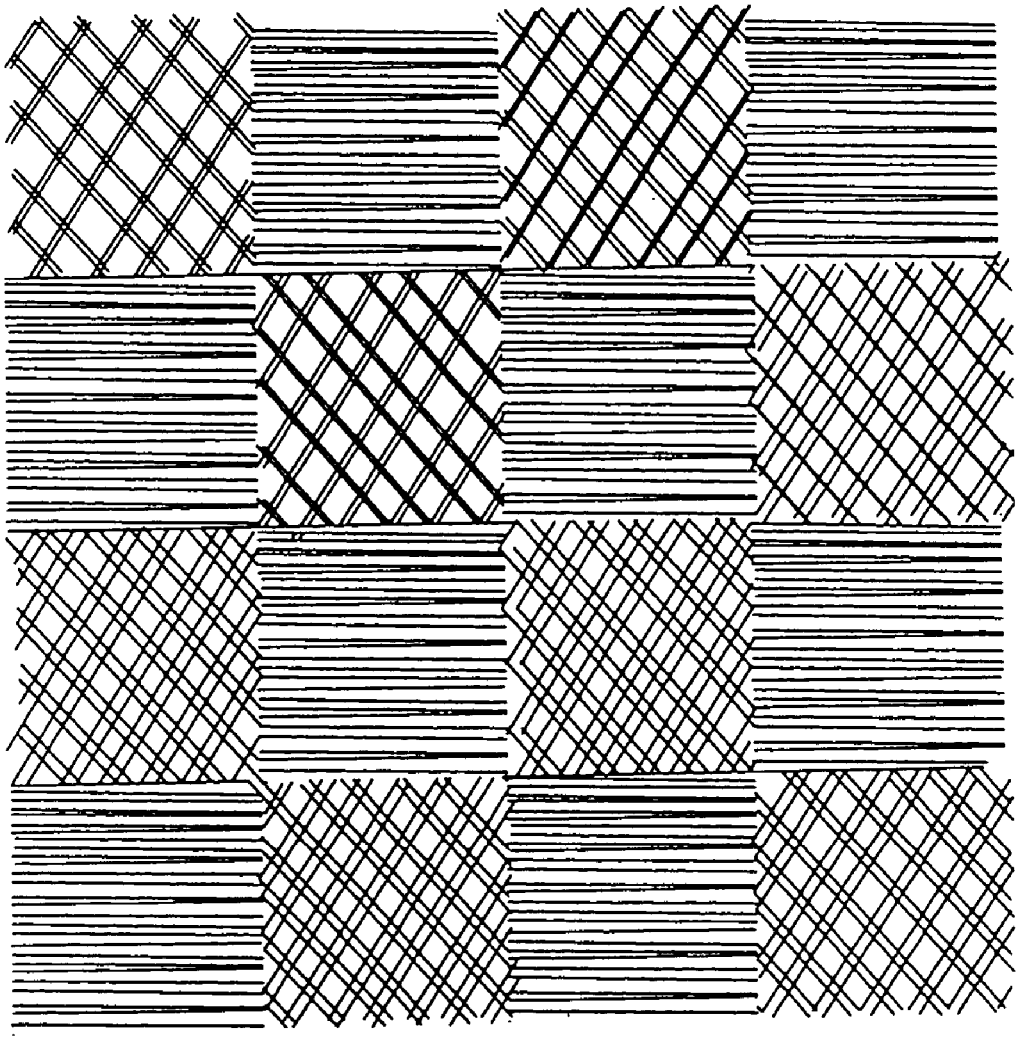
FIG. 14 is a top plan view of another product of the present process for centrifugal material disposition.

Once all, or at least some, of the desired lines of material 202 have been deposited onto the sheet material 200, the sheet material 200 can be flattened out. Once the sheet material 200 is so flattened, the flat sheet material 200 will have the appearance of being wavy, wrinkled, curved, or otherwise non-flat due to the previously straight lines of material 202 now being curved or otherwise non-straight on the flat sheet material 200. Such a resulting product is shown generally in FIGS. 7 and 13. Another resulting product of the present invention is shown in FIG. 14 where masking techniques have been employed to produce an arrangement of varied line orientations.

Figure 8:
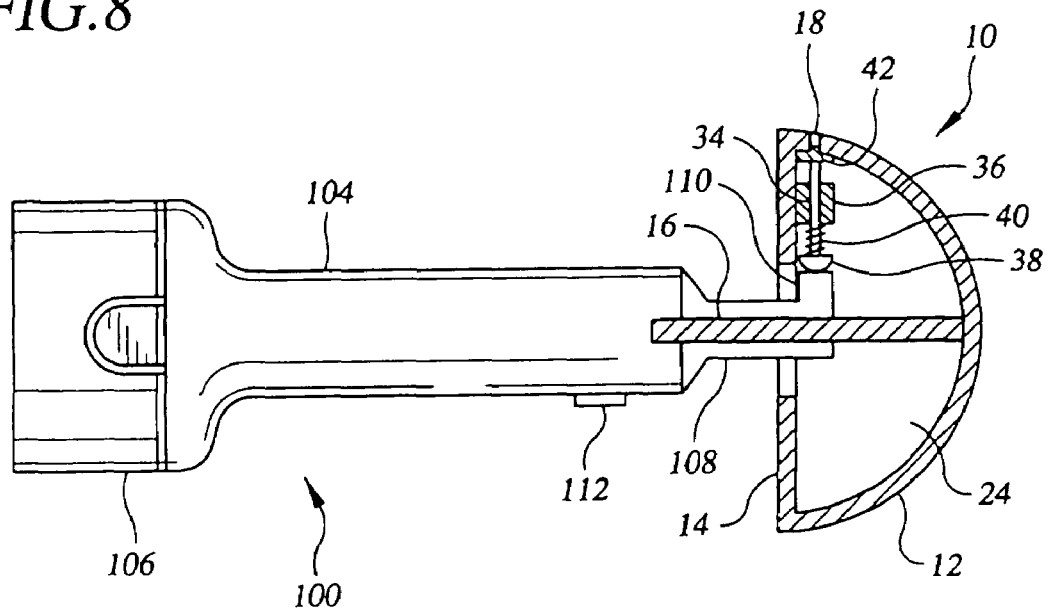
FIG. 8 is a view in side elevation of an alternative centrifugal dispensing drum according to the present invention shown with an integral driving arrangement.

FIG. 8 shows an alternative embodiment of the centrifugal dispensing drum 10, which in this case is operably associated with an integral driving arrangement 100. The driving arrangement 100 and the centrifugal dispensing drum 10 in this case are crafted as a single unit. The driving arrangement 100 has a handle portion 104 that acts as a motor housing. A battery pack 106 provides power to the driving arrangement 100. A speed control switch 112 allows a user to induce a rotation of the centrifugal dispensing drum 10 at a selected angular speed.

In this embodiment, the centrifugal dispensing drum 10 again has an annular open inner volume 24 defined by an outer shell 12, which again is hemispherical, and a rear wall 14, which again is flat. A drive shaft 16 again has a distal end fixed to the outer shell 12, a body portion extending through the inner volume 24 and through the rear wall 14, and a proximal portion drivably coupled to the driving arrangement 100. An exit aperture 18 is again disposed in the periphery of the outer shell 12.

This embodiment of the centrifugal dispensing drum 10 varies from earlier embodiments in that it further incorporates a means for sealing off the exit aperture 18 in a directionally sensitive manner. With this, the centrifugal dispensing drum 10 is prevented from emitting flowable material 20 in unintended directions such that the flowable material can be properly directed onto a product 200 to be decorated. A plurality of different means for sealing off the exit aperture 18 in a directionally sensitive manner could in all likelihood be devised.

In this case, the directionally sensitive sealing off means comprises a cam operated plunger arrangement. More particularly, the directionally sensitive sealing off means is founded on a plunger 34 that is slidably retained by a retaining block 36 adjacent to the rear wall 14 of the centrifugal dispensing drum 10. The plunger 34 has a proximal end with a smooth follower 38 thereon that rides against a cam 110 that is fixed relative to the driving arrangement 100. The plunger 34 projects radially outward from the cam 110 and has a second, distal end with a plug 42, which can be of a polymeric material, formed thereon that can seal off the exit aperture 18. A spring 40 biases the follower 38 and the plunger 34 in general into engagement with the fixed cam 110.

Figure 9:
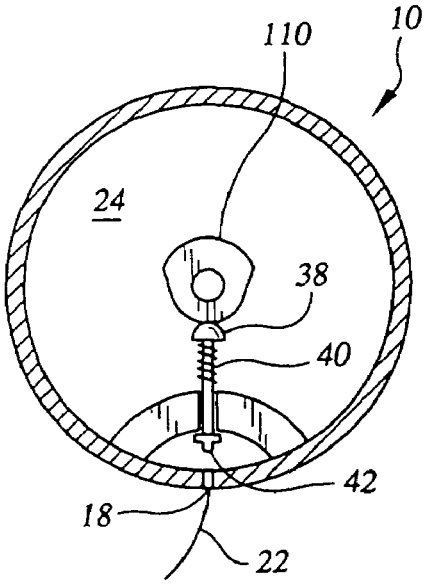
FIG. 9 is a sectioned view in front elevation of the centrifugal dispensing drum of FIG. 8 in a material dispensing configuration.
Figure 10:
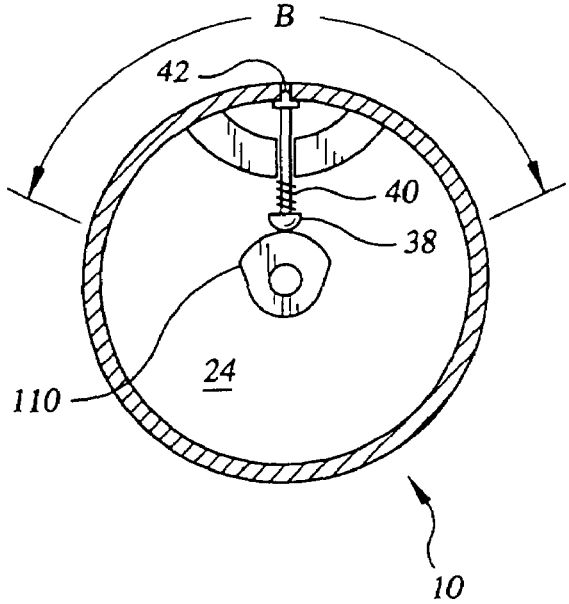
FIG. 10 is a sectioned view in front elevation of the centrifugal dispensing drum of FIG. 8 in a material blocking configuration.

Under this arrangement, as can be seen most clearly in FIGS. 9 and 10, as the centrifugal dispensing drum 10 rotates relative to the driving arrangement 100, the follower 38 will travel along the surface of the cam 110. When the follower 38 is moving over a narrower portion of the cam 110, the spring 40 will bias the plunger 34 to a retracted position whereby the exit aperture 18 will be open and a string of material 22 can be emitted from the open inner volume 24. However, as the follower 38 moves over the broadened portion of the cam 110, the plunger 34 will move to an extended position whereupon the plug 42 will seal off the exit aperture 18 and flowable material will be prevented from exiting from the open inner volume 24 over a blocked segment B of the rotation of the centrifugal dispensing drum 10.

Figure 10A:
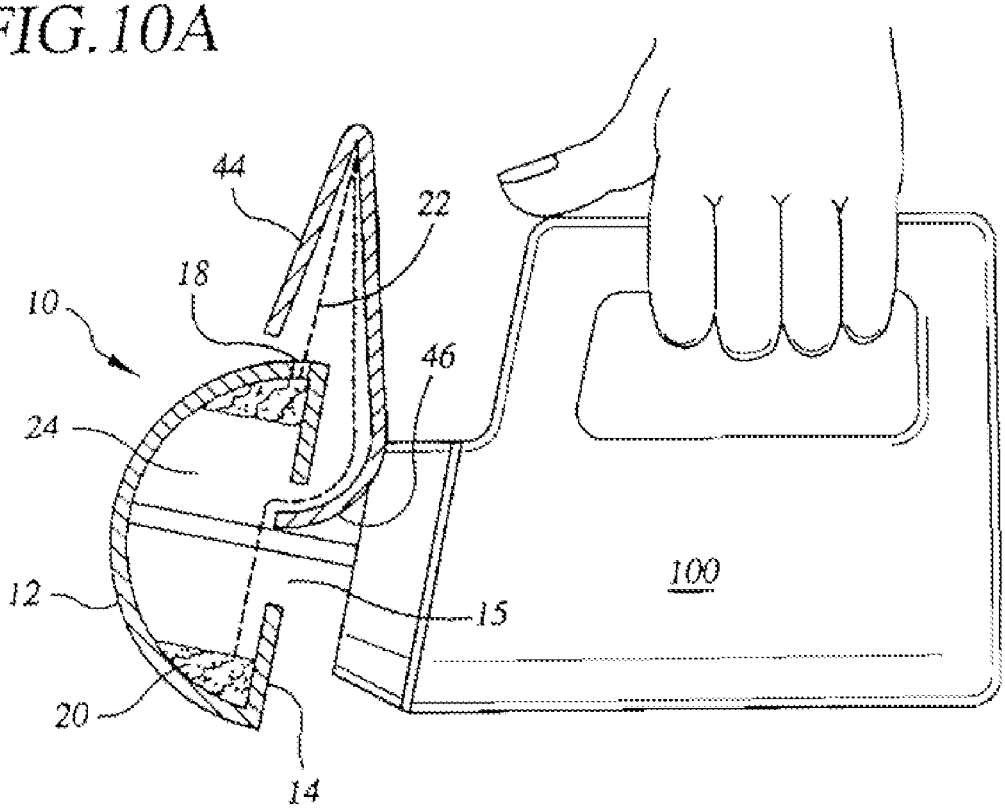
FIG. 10A is a partially sectioned view in side elevation of an alternative embodiment of the centrifugal dispensing drum shown operably associated with a power drill.

Another means for preventing flowable material from being emitted in unintended directions is shown in FIG. 10A. There, the means for preventing flowable material from being emitted in unintended directions comprises a catch shell 44 with a portion disposed in radial alignment with the exit aperture 18 over a given portion of the rotation of the centrifugal dispensing drum 10. The catch shell 44 is secured relative to the drill 100 whereby it will not rotate with the centrifugal dispensing drum 10.

A lip 46 of the catch shell 44 curves through the annular open ring 15 and into the inner volume 24 of the centrifugal dispensing drum 10. Under this arrangement, the string of material 22 will be caught by the catch shell 44 of the portion of the rotation where it is disposed. Where the catch shell 44 is disposed above the centrifugal dispensing drum 10, flowable material 20 that is caught by the catch shell 44 will tend to be returned to the inner volume 24 by dripping from the lip 46.

Figure 11:
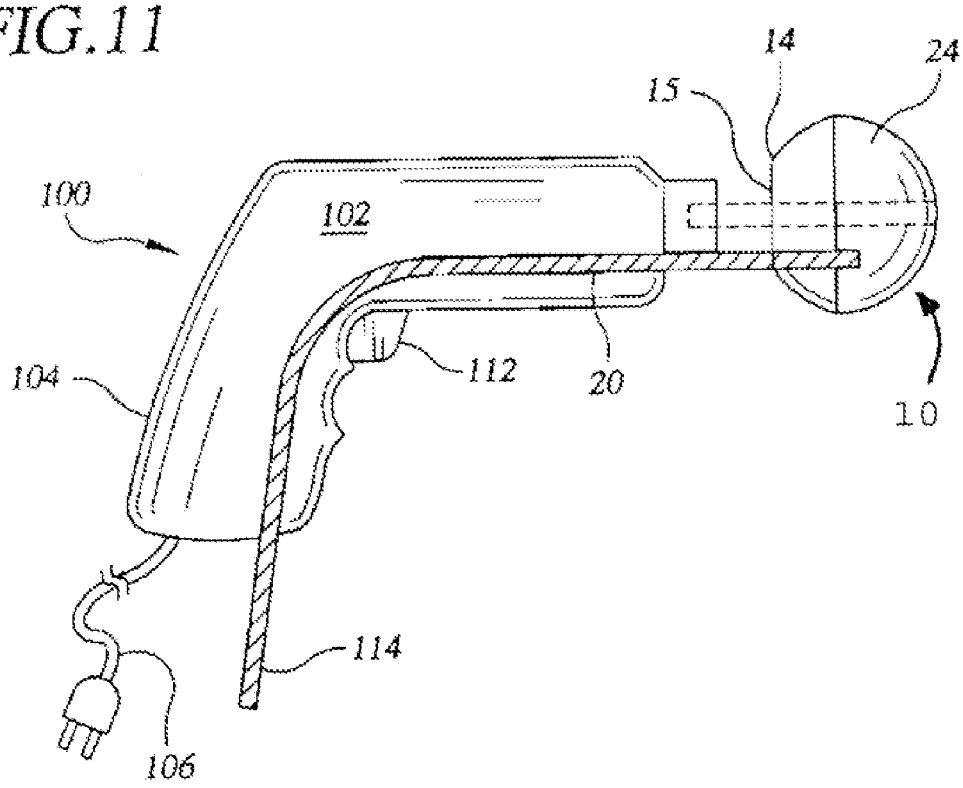
FIG. 11 is a view in side elevation of another centrifugal dispensing drum and integral driving arrangement according to the present invention.

FIG. 11 shows yet another embodiment of the invention wherein the centrifugal dispensing drum 10 is again formed as a single unit with the driving arrangement 100. In this case, however, power is supplied to the driving arrangement 100 not by a battery pack but by means of a power cord 106. Also, the centrifugal dispensing drum 10 and the driving arrangement 100 further incorporate a feeding tube 114 for supplying flowable material 20 to the open inner volume 24 of the centrifugal dispensing drum 10. This supply can be achieved in a number of ways including by means of providing an annular open ring 15 in the rear wall 14 of the centrifugal dispensing drum 10 and inserting a distal end of the feeding tube 114 therethrough into the open inner volume 24 of the centrifugal dispensing drum 10. With this, flowable material 20 could be readily introduced into the open inner volume 24 even during rotation of the centrifugal dispensing drum 10.

Figure 18:
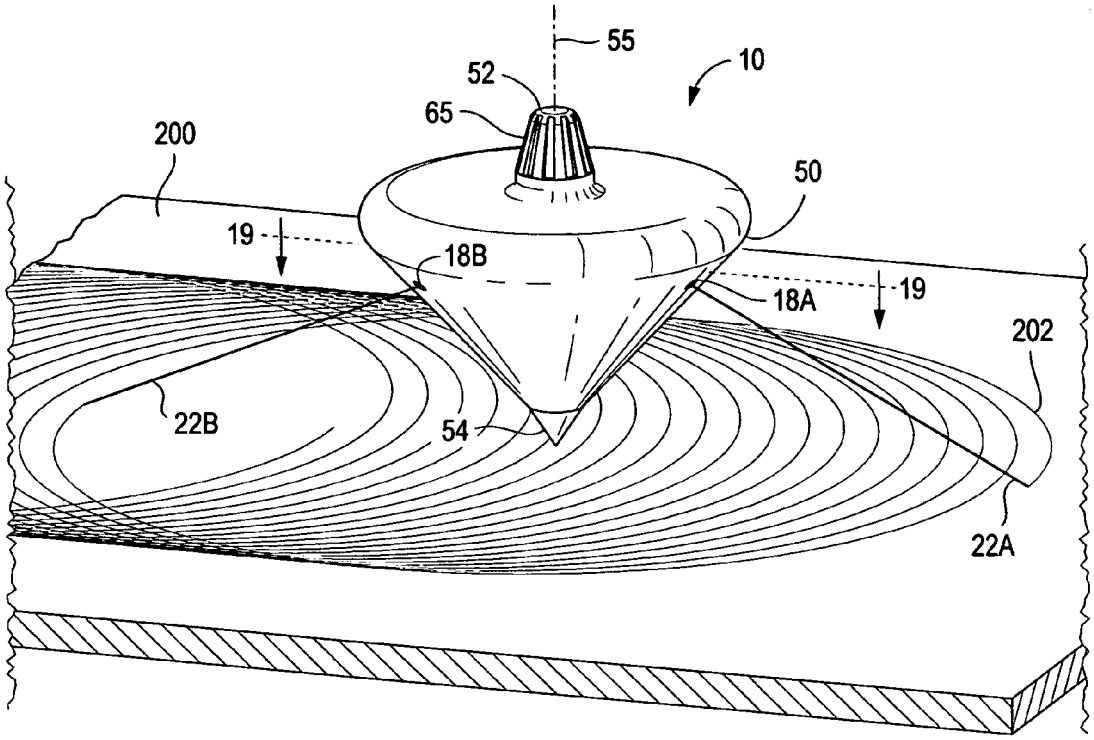
FIG. 18 is a perspective view of yet another embodiment of a centrifugal dispensing drum according to the present invention.

A further variant of the centrifugal dispensing drum 10 of the present invention is shown in FIG. 18. There, the centrifugal dispensing drum 10 takes the form of a top. The depicted top-type centrifugal dispensing drum 10 is merely exemplary of the many possible types and shapes of tops that are each within the scope of the present invention. Possible shapes include, but are not limited to, cylindrical and conoidal structures, each normally having a tapering tip portion on which the top can be made to spin. For example, the centrifugal dispensing drum 10 of FIG. 18 has a conical body portion 50 that terminates in a tip portion 54 on which the body portion 50 can spin about an axis of rotation 55.

Figure 20:
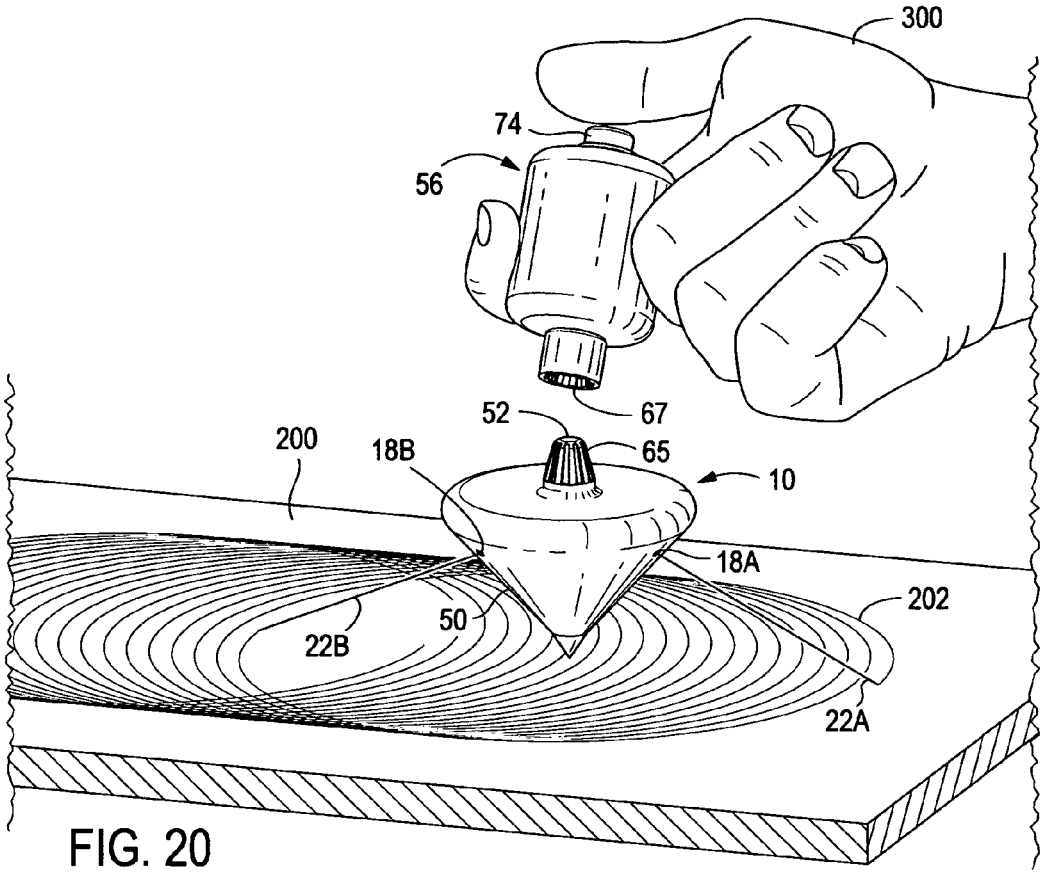
FIG. 20 is a perspective view of a further embodiment of a centrifugal dispensing drum.
Figure 23:
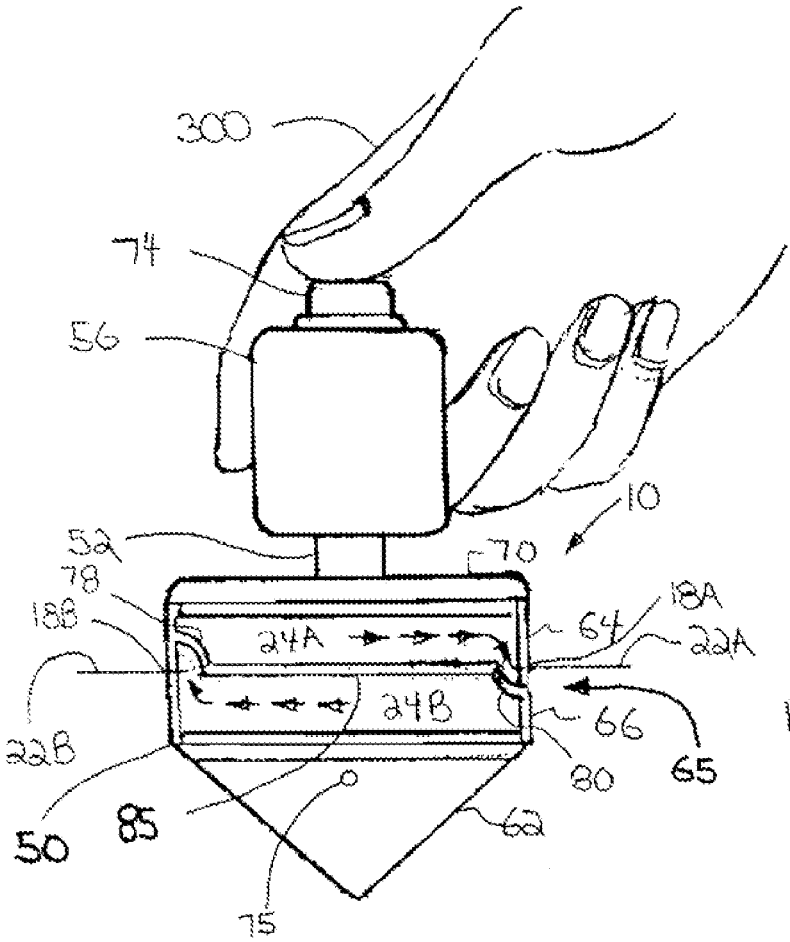
FIG. 23 is a partially sectioned view in front elevation of an alternative centrifugal dispensing drum pursuant to the present invention.

A generally annular knob member 52, which is centered relative to the axis of rotation 55 of the body portion 50, projects from the body portion 50 to facilitate a spinning of the centrifugal dispensing drum 10. That spinning of the centrifugal dispensing drum 10 could certainly be done manually by a simple gripping and rotating of the knob member 52. Alternatively, as will be described further hereinbelow, a rotation of the knob member 52 and thus centrifugal dispensing drum 10 in general can be induced by a motorized unit 56 as is depicted in FIGS. 20 and 23. In either case, the knob member 52 can have longitudinal ridges 65 spaced thereover to improve gripping or engagement relative to the knob member 52.

Where a motorized unit 56 is employed to induce a rotation of the centrifugal dispensing drum 10, the motorized unit 56 can engage the centrifugal dispensing drum 10, possibly by engagement with the knob member 52 by, for example, an intermeshing of longitudinal ridges 67 on the motorized unit 56 with the longitudinal ridges 65 disposed on the knob member 52. In such a case, the longitudinal ridges 65 on the knob member 52 and the longitudinal ridges 67 on the motorized unit 56 can act and be shaped as gear teeth. The motorized unit 56 can have a trigger, such as a button 74, or other means that can be activated by a user, such as by a pressing with a user's hand 300, for inducing the motorized unit 56 into operation to yield a rotation of the knob member 52 and the centrifugal dispensing drum 10.

The centrifugal dispensing drum 10 can have one or more open inner volumes for retaining a volume of fluid or other flowable material, and one or more exit apertures can be associated with each open inner volume, such as adjacent to a peripheral edge thereof. Under such an arrangement, a rotation of the centrifugal dispensing drum 10 will induce centrifugal action in relation to the volume of flowable material. With sufficient centrifugal action, flowable material will tend to be ejected from the exit aperture or apertures of each open inner volume in string or any other form and can leave traces of material, possibly lines of material, on adjacent surfaces.

Figure 19:
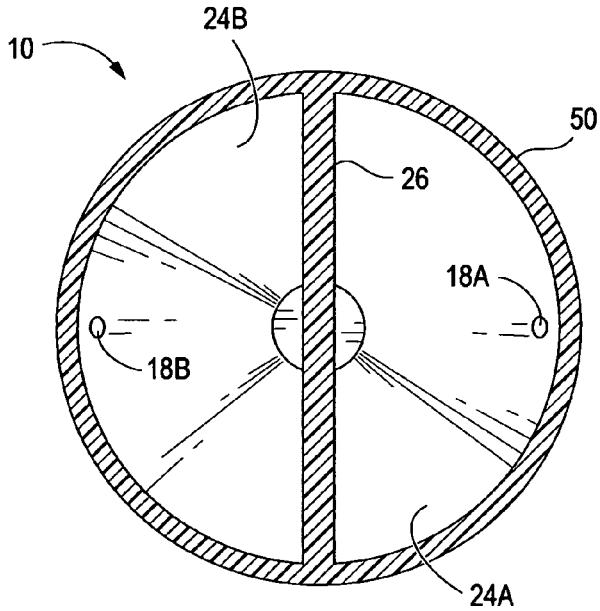
FIG. 19 is a sectioned top plan view of the centrifugal dispensing drum of FIG. 18 taken along the line 19-19 in FIG. 18.

The embodiments of FIGS. 18, 19, and 20, for example, has first and second exit apertures 18A and 18B associated with first and second open inner volumes 24A and 24B; respectively. When the centrifugal dispensing drum 10 is rotated with sufficient angular velocity, centrifugal action will induce flowable material retained in the open inner volumes 24A and 24B to be emitted through the exit apertures 18A and 18B to create strings 22A and 22B or other emissions of material. The strings 22A and 22B can produce lines of material 202 onto an adjacent substrate 200, which could comprise any structure or material whatsoever.

As FIG. 19 shows, where the centrifugal dispensing drum 10 is subdivided into multiple separate open inner volumes, such as first and second open inner volumes 24A and 24B, the open inner volumes 24A and 24B can be formed in a side-by-side relationship by, for example, a radial subdivision of the body portion 50. That radial subdivision can be accomplished, for example, by one or more radial dividing walls 26.

Each open inner volume 24A and 24B can be employed to retain a different material, such as a different color of paint, a differently textured material, or a different decorative or other foodstuff such as chocolate or sugar, or any other material or combination of materials.

While a radially subdivided body portion can certainly be effective in achieving many of the goals of the present invention, the present inventor has come to appreciate that certain difficulties can arise due to the side-by-side nature of the open inner volumes 24A and 24B. Most notably, where the volume and weight of the material disposed in the open inner volumes 24A and 24B are not exactly equal, the centrifugal dispensing drum 10 will be out of balance and will not spin properly or will not spin at all. Such an imbalance could have numerous sources including where materials of different densities are employed, where materials have different viscosities such that they are dispensed at different weights, and, additionally or alternatively, simply where different volumes of materials are provided at the start.

Figure 22:
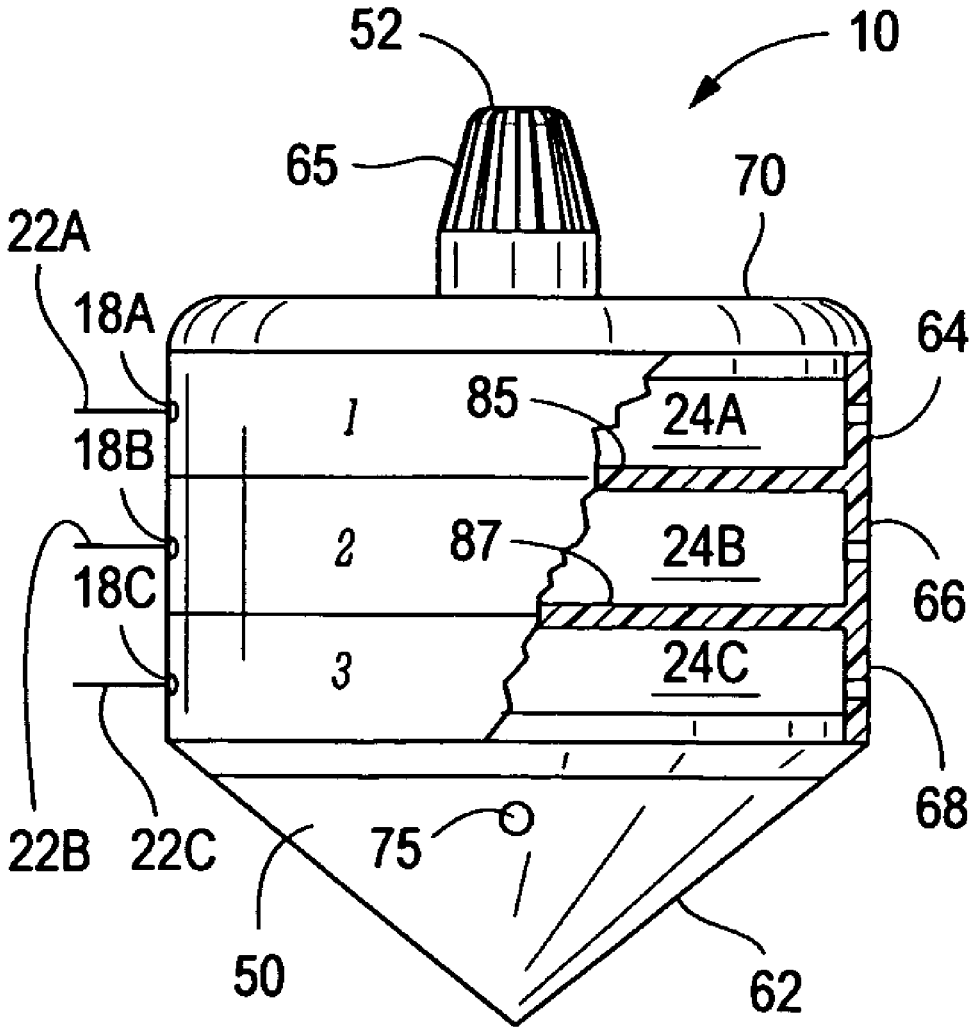
FIG. 22 is a view in front elevation of an additional centrifugal dispensing drum embodiment.
Figure 24:
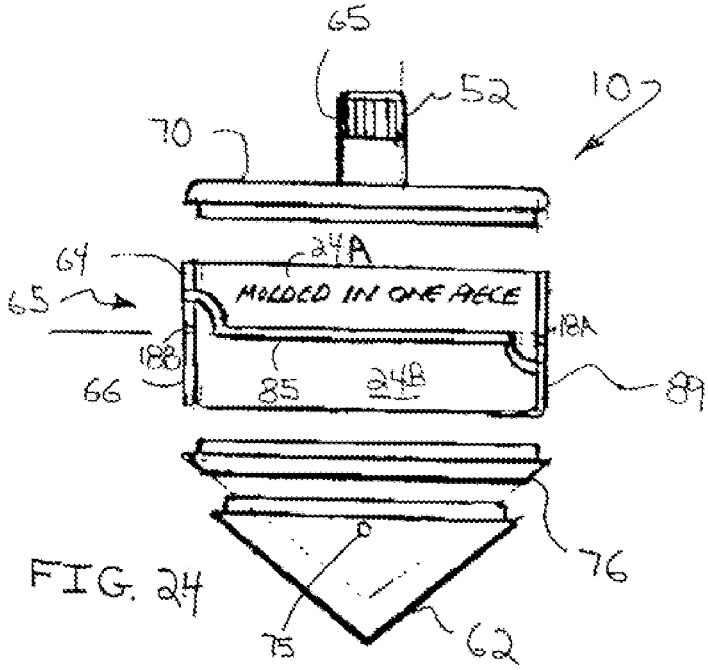
FIG. 24 is a partially sectioned view in front elevation of the centrifugal dispensing drum of FIG. 23 in a disassembled configuration.

To overcome such issues, the embodiments of FIGS. 22, 23, and 24 dispose the open inner volumes 24A, 24B, and any further open inner volumes in a stacked relationship. For example, in the embodiment of FIG. 22, first, second, and third compartments 64, 66, and 68, each with an open inner volume 24A, 24B, and 24C, are disposed in a stacked relationship. As a result, materials disposed within the open inner volumes 24A, 24B, and 24C can differ in density, volume, viscosity, and otherwise without an adverse effect on the balance of the centrifugal dispensing drum 10. A first dividing plate 85 separates the first and second open inner volumes 24A and 24B, and a second dividing plate 87 separates the second and third open inner volumes 24B and 24C.

The centrifugal dispensing drum 10 has a cap member 70 that retains the knob member 52 and caps the first open inner volume 24B of the first compartment, and the third compartment 68 is coupled to a conical base member 62. The cap member 70, the first, second, and third compartments 64, 66, and 68, and the base member 62 can be formed unitarily. Alternatively, one or more components of the centrifugal dispensing drum 10 can be separably coupled by any appropriate means, such as snap fitting or any other effective arrangement. For example, the base member 62 could be separable from the third compartment 68, the cap member 70 can be separable from the first compartment 64, and the second compartment 66 can be separable from one or both of the first and third compartments 64 and 68. With this, the open inner volumes 24A, 24B, and 24C can be separately filled, cleaned, and otherwise accessed. Furthermore, such constructions of the centrifugal dispensing drum 10 can enable usage with variable numbers of compartments, whether just a first compartment 64, first and second compartments 64 and 66, or first, second, third, and possibly further compartments 64, 66, and 68.

Still further, as one can appreciate by reference to FIGS. 22, 23, and 24, the base member 62 of the centrifugal dispensing drum 10 can itself be employed to retain a volume of flowable material. To allow flowable material to be emitted from the base member 62, an exit aperture 75 can be fluidically associated therewith. Under such an arrangement, the base member 62 could supplement any other compartments 64, 66, and/or 68. Alternatively, the base member 62 could act as the only means for retaining and emitting flowable material from the centrifugal dispensing drum 10.

Another modular centrifugal dispensing drum 10 is depicted in FIGS. 23 and 24. There, the centrifugal dispensing drum 10 has a separable compartment cartridge 65 with an annular peripheral wall 89 and a dividing plate 85 that divides the volume defined by the annular peripheral wall 89 into first and second open inner volumes 24A and 24B. The compartment cartridge 65 can be formed unitarily, such as by molding or any other method, or as an assemblage of parts. The first open inner volume 24A has an exit aperture 18A associated therewith for enabling an emission of material, and the second inner volume 24B has an exit aperture 18B associated therewith for enabling an emission of material therefrom.

In the depicted embodiment, the exit apertures 18A and 18B are disposed at substantially equal heights on the compartment cartridge 65. To enable such a disposition of the exit apertures 18A and 18B, the dividing plate 85 has a downturned segment 80 adjacent to the first exit aperture 18A and an upturned segment 78 adjacent to the second exit aperture 18B. In arrangements that employ such a means for disposing multiple exit apertures 18A and 18B at substantially equal heights, it will be noted that the output of flowable material from the centrifugal dispensing drum 10 will be effectively carried out on a single plane.

The cap member 70 can sealingly engage the compartment cartridge 65, such as to the first compartment side thereof, by any effective method including by a threaded engagement, a snap fit, or by any other suitable means. Similarly, a lid member 76 can sealingly engage the compartment cartridge 65, such as to the second compartment side thereof, by any effective method for doing so, again including by threaded engagement, snap fit, and any other proper arrangement. The lid member 76 can be formed integrally with or can be coupled to the conical base member 62.

Under the abovedescribed arrangement, the cap member 70 and the lid member 76 can be separated from the compartment cartridge 65. Material, such as a paint, syrup, particulate matter, or any other material to be dispensed from the first exit aperture 18A, can be deposited into the first open inner volume 24A. The cap member 70 can then be engaged with the compartment cartridge 65 to seal the material within the open inner volume 24A. Either before or after the sealing of material within the first open inner volume 24A, material to be dispensed from the second exit aperture 18B can be deposited into the second open inner volume 24B and the lid member 76 can be engaged with the compartment cartridge 65 to seal the material to be dispensed therewithin. The centrifugal dispensing drum 10 can then be spun either manually or by operation of a motorized unit 56 as is depicted in FIG. 23 to yield an emission of strings 22A and 22B or other portions of material from the open inner volumes 24A and 24B. Of course, it is not required that both open inner volumes 24A and 24B be filled, and it is possible that further open inner volumes could be provided, possibly with the use of additional compartment cartridges 65 or a component cartridge 65 with additional open inner volumes.

Figure 21:
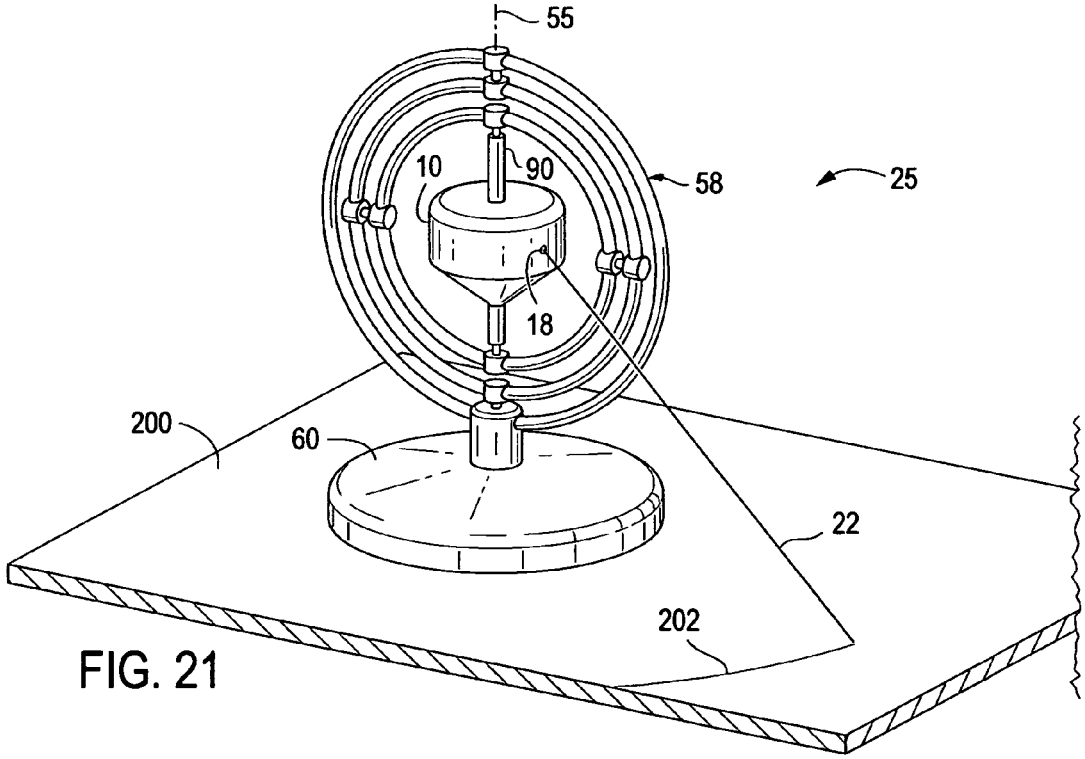
FIG. 21 is a perspective view of a gyroscopic arrangement retaining a centrifugal dispensing drum as taught herein.

A further variation of the present invention is depicted in FIG. 21 where the centrifugal dispensing drum 10 is incorporated into a gimbaled gyroscopic arrangement 25. The gimbaled gyroscopic arrangement 25 has a gimbal structure 58, which in this case is a three gimbal structure. The gimbal structure 58 is supported by a base 60. The centrifugal dispensing drum 10 acts as the rotor of the gimbaled gyroscopic arrangement 25 as it rotates on a spin axle 90 about the axis of rotation 55 within the gimbal structure 58. Under this construction, with material to be dispensed disposed therewithin, when the centrifugal dispensing drum 10 is rotated on the spin axle 90 about the axis of rotation at a sufficient angular velocity, material will be dispensed through the exit aperture 18, such as in the form of string 22, to produce traces, such as lines 202, of material on an adjacent substrate 200, which can comprise any structure or arrangement. The gimbaled gyroscopic arrangement 25 can thus be used to produce designs and decorations of the adjacent substrate 200.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

I claim as deserving the protection of Letters Patent:

1. A centrifugal dispensing apparatus for depositing volumes of flowable material onto a surface, the centrifugal dispensing apparatus comprising:

a centrifugal dispensing drum with a body portion and at least one open inner volume for retaining a volume of flowable material wherein the body portion of the centrifugal dispensing drum comprises a top structure for spinning about an axis of rotation wherein the body portion of the centrifugal dispensing drum has a conical base portion that terminates in a tip portion on which the centrifugal dispensing drum can spin;

an exit aperture in fluidic association with the at least one open inner volume of the centrifugal dispensing drum for allowing flowable material to pass therethrough by centrifugal force during a rotation of the centrifugal dispensing drum;

whereby the centrifugal dispensing drum can dispense flowable material onto a surface by a spinning of the centrifugal dispensing drum while a volume of flowable material is retained in the at least one open inner volume of the centrifugal dispensing drum.

2. The centrifugal dispensing apparatus of claim 1 further comprising a knob member that projects from the body portion of the centrifugal dispensing drum wherein the knob member is substantially centered relative to the axis of rotation of the centrifugal dispensing drum.

3. The centrifugal dispensing apparatus of claim 1 further comprising a motorized unit for inducing a rotation of the centrifugal dispensing drum and a means for enabling a drivable association between the centrifugal dispensing drum and the motorized unit.

4. The centrifugal dispensing apparatus of claim 3 wherein the means for enabling a drivable association between the centrifugal dispensing drum and the motorized unit comprises a knob member that projects from the body portion of the centrifugal dispensing drum wherein the knob member is substantially centered relative to the axis of rotation of the centrifugal dispensing drum.

5. The centrifugal dispensing apparatus of claim 4 further comprising a trigger means for enabling an inducing of the motorized unit into operation.

6. The centrifugal dispensing apparatus of claim 1 wherein the centrifugal dispensing drum has at least first and second separate open inner volumes and wherein an exit aperture is disposed in fluidic association with each of the first and second open inner volumes.

7. The centrifugal dispensing apparatus of claim 6 wherein the first and second open inner volumes are separated by at least one radial dividing wall whereby the first and second open inner volumes are disposed in a side-by-side relationship.

8. The centrifugal dispensing apparatus of claim 6 wherein the first and second open inner volumes are disposed in a stacked relationship.

9. The centrifugal dispensing apparatus of claim 8 wherein the first and second open inner volumes are separated by a dividing plate.

10. The centrifugal dispensing apparatus of claim 9 wherein the first open inner volume is disposed atop the second open inner volume when the centrifugal dispensing drum is disposed in an upright orientation, wherein the dividing plate has a downturned segment adjacent to the exit aperture associated with the first open inner volume and wherein the dividing plate has an upturned segment adjacent to the exit aperture associated with the second open inner volume, and wherein the exit apertures of the first and second open inner volumes are disposed at substantially equivalent heights when the centrifugal dispensing drum is disposed in an upright orientation.

11. The centrifugal dispensing apparatus of claim 6 wherein the first open inner volume is disposed atop the second open inner volume when the centrifugal dispensing drum is disposed in an upright orientation and wherein the centrifugal dispensing drum further comprises a removable cap member for selectively sealing off the first open inner volume of the centrifugal dispensing drum except for the exit aperture associated with the first open inner volume.

12. The centrifugal dispensing apparatus of claim 11 wherein the first and second open inner volumes are defined at least in part by a compartment cartridge with a peripheral wall and a dividing plate, wherein the first open inner volume is disposed to a first side of the dividing plate and wherein the second open inner volume is disposed to a second side of the dividing plate, and wherein the removable cap member is selectively engageable with the compartment cartridge to seal off the first open inner volume except for the exit aperture associated with the first open inner volume.

13. The centrifugal dispensing apparatus of claim 12 wherein the centrifugal dispensing drum further comprises a removable lid member that is selectively engageable with the compartment cartridge to seal off the second open inner volume except for the exit aperture associated with the second open inner volume.

14. The centrifugal dispensing apparatus of claim 13 wherein the centrifugal dispensing drum further comprises a base member and a means for coupling the base member to the compartment cartridge.

15. The centrifugal dispensing apparatus of claim 14 wherein the lid member and the base member comprise separable members.

16. A centrifugal dispensing apparatus for depositing volumes of flowable material onto a surface, the centrifugal dispensing apparatus comprising:

a centrifugal dispensing drum with a body portion and at least one open inner volume for retaining a volume of flowable material wherein the body portion of the centrifugal dispensing drum comprises a top structure for spinning about an axis of rotation;

an exit aperture in fluidic association with the at least one open inner volume of the centrifugal dispensing drum for allowing flowable material to pass therethrough by centrifugal force during a rotation of the centrifugal dispensing drum;

wherein the body portion of the centrifugal dispensing drum further comprises a conical base member and a compartment cartridge, wherein the at least one open inner volume is defined by the compartment cartridge, and wherein the base member and the compartment cartridge are separable;

whereby the centrifugal dispensing drum can dispense flowable material onto a surface by a spinning of the centrifugal dispensing drum while a volume of flowable material is retained in the at least one open inner volume of the centrifugal dispensing drum.

17. The centrifugal dispensing apparatus of claim 16 further comprising a removable cap member wherein the removable cap member is selectively engageable with the compartment cartridge to seal off at least one open inner volume except for the exit aperture associated with the at least one open inner volume.

18. The centrifugal dispensing apparatus of claim 17 wherein the centrifugal dispensing drum includes a plurality of open inner volumes with an exit aperture in fluidic association with each open inner volume and wherein the centrifugal dispensing drum further comprises a removable lid member that is selectively engageable with the compartment cartridge to seal off at least one open inner volume except for the exit aperture associated with the at least one open inner volume.

19. The centrifugal dispensing apparatus of claim 18 wherein the centrifugal dispensing drum further comprises a base member and a means for coupling the base member to the compartment cartridge.

20. The centrifugal dispensing apparatus of claim 19 wherein the lid member and the base member comprise separable members.

21. The centrifugal dispensing apparatus of claim 16 wherein the compartment cartridge defines at least first and second separate open inner volumes and wherein an exit aperture is disposed in fluidic association with each of the first and second open inner volumes.

22. A centrifugal dispensing apparatus for depositing volumes of flowable material onto a surface, the centrifugal dispensing apparatus comprising:

a gimbaled gyroscopic arrangement;

a centrifugal dispensing drum with a body portion and at least one open inner volume for retaining a volume of flowable material wherein the centrifugal dispensing drum is rotatably retained by the gimbaled gyroscopic arrangement for rotating about an axis of rotation;

an exit aperture in fluidic association with the at least one open inner volume of the centrifugal dispensing drum for allowing flowable material to pass therethrough by centrifugal force during a rotation of the centrifugal dispensing drum;

whereby the centrifugal dispensing drum can dispense flowable material onto a surface by a spinning of the centrifugal dispensing drum while a volume of flowable material is retained in the at least one open inner volume of the centrifugal dispensing drum.

* * * * *